US011675307B2

(12) United States Patent
Shimoi

(10) Patent No.: US 11,675,307 B2
(45) Date of Patent: Jun. 13, 2023

(54) IMAGE FORMING APPARATUS

(71) Applicant: CANON KABUSHIKI KAISHA, Tokyo (JP)

(72) Inventor: Yasuhiro Shimoi, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/742,512

(22) Filed: May 12, 2022

(65) Prior Publication Data

US 2022/0390892 A1 Dec. 8, 2022

(30) Foreign Application Priority Data

Jun. 8, 2021 (JP) ..... JP2021-095938

(51) Int. Cl.
*G03G 21/18* (2006.01)

(52) U.S. Cl.
CPC ..... *G03G 21/1842* (2013.01)

(58) Field of Classification Search
CPC ..... G03G 21/1842
See application file for complete search history.

(56) References Cited

U.S. PATENT DOCUMENTS 6,993,267 B2 * 1/2006 Yoshiyuki ..... G03G 21/1832 399/102
7,127,192 B2 * 10/2006 Batori ..... G03G 15/0817 399/104
7,532,841 B2 * 5/2009 Tanaka ..... G03G 21/185 399/116
7,929,881 B2 * 4/2011 Yoshino ..... G03G 21/1842 399/113
8,055,154 B2 * 11/2011 Iikura ..... G03G 21/1832 399/114
8,095,036 B2 * 1/2012 Yoshino ..... G03G 21/1828 399/114
9,348,305 B2 * 5/2016 Kanai ..... G03G 21/1842
9,429,904 B2 * 8/2016 Yasumoto ..... G03G 21/1832
(Continued)

FOREIGN PATENT DOCUMENTS

JP 2003-173076 A 6/2003
JP 2003173076 A * 6/2003
(Continued)

*Primary Examiner* — Francis C Gray
(74) *Attorney, Agent, or Firm* — Venable LLP

(57) ABSTRACT

A cover covering an image bearing member such that the image bearing member is kept unexposed includes a holding portion holding an end portion of a sealing sheet sealing an opening portion such that an initial developer is accommodated in an accommodating chamber. Due to release of the seal of the opening portion with the sealing sheet, the initial developer accommodated in the accommodating chamber moves from the accommodating chamber to a second chamber through the opening portion, and the seal of the opening portion with the sealing sheet is released due to movement of a casing with respect to the cover and detachment of the cover from the casing, responsive to an operation of movement of a cartridge in an attachment direction, with the holding portion holding the end portion of the sealing sheet and a regulation portion regulating movement of the cover.

3 Claims, 12 Drawing Sheets

(56) References Cited

U.S. PATENT DOCUMENTS

| | | | | |
|---|---|---|---|---|
| 2008/0138110 | A1* | 6/2008 | Yoshino | G03G 21/1832 399/114 |
| 2008/0253803 | A1* | 10/2008 | Nittani | G03G 15/0882 399/110 |
| 2010/0209137 | A1* | 8/2010 | Takiguchi | G03G 21/1821 399/113 |
| 2011/0103830 | A1* | 5/2011 | Nakamura | G03G 21/1828 399/115 |
| 2019/0265613 | A1 | 8/2019 | Ninomiya | |

FOREIGN PATENT DOCUMENTS

| | | | |
|---|---|---|---|
| JP | 2015-087490 | A | 5/2015 |
| JP | 6192486 | B2 | 9/2017 |
| JP | 2019-148648 | A | 9/2019 |

* cited by examiner

IMAGE FORMING APPARATUS

BACKGROUND OF THE INVENTION

Field of the Invention

The present invention relates to an image forming apparatus including a process cartridge that includes an image bearing member and is detachably attachable to the image forming apparatus.

Description of the Related Art

A conventionally mainstream electrophotographic image forming apparatus includes a process cartridge including an image bearing member and a developing device that develops, with a developer, a latent image formed on the image bearing member, integrated together, in which the process cartridge is detachably attached to the image forming apparatus and the developer is in advance accommodated in the developing device. For such a developing device, the following configuration has been known in order to inhibit an initial developer accommodated in the developing device from deteriorating due to exposure to the outside air high in temperature and humidity or from scattering outward from the developing device, before first use.

A developing device has an accommodating chamber inside, in which an initial developer is accommodated in the accommodating chamber and the opening of the accommodating chamber is sealed with a sealing sheet, namely, the accommodating chamber accommodating the initial developer is hermetically sealed. Then, for first use, the sealing sheet is pulled out from the developing device to open the accommodating chamber.

Such a developing device includes an accommodating chamber having an opening that extends in its longitudinal direction and is sealed with a sealing sheet (refer to Japanese Patent Application Laid-Open No. 2019-148648). In particular, the accommodating chamber is hermetically sealed with the sealing sheet attached to the outer circumferential portion of the opening by welding or adhesion, and the sealing sheet is folded back at one end portion in the longitudinal direction. Then, on the side on which the other end portion is located in the longitudinal direction, the folded-back sealing sheet is pulled out from one side to the other side in the longitudinal direction, so that the accommodating chamber is opened. Such a manner has been widely adopted.

As a known configuration, a process cartridge including an image bearing member and a developing device integrated together has a cover that protects the surface of the image bearing member against damage before the process cartridge is attached to an image forming apparatus. Japanese Patent Application Laid-Open No. 2015-87490 discloses a configuration enabling removal of a cover simultaneous with an operation of attachment of a process cartridge to an image forming apparatus.

However, the conventional process cartridge described above requires, for first use, the work of pulling out a sealing sheet, in addition to the work of removal of the cover covering the surface of an image bearing member. Thus, such a sealing sheet is likely to be accidentally left, leading to a problem in operability.

SUMMARY OF THE INVENTION

It is desirable to inhibit the seal of an opening portion with a sealing sheet from being accidentally left.

According to one aspect of the present invention, provided is an image forming apparatus including:

a cartridge including: an image bearing member; a developing device configured to develop, with a developer containing toner and carriers, an electrostatic latent image formed on the image bearing member; a casing supporting the image bearing member; and a cover detachably attached to the casing, the cover covering the image bearing member such that the image bearing member is kept unexposed;

an attachment portion to which the cartridge is attachable; and a regulation portion configured to regulate movement of the cover in contact with the cover in response to movement of the cartridge in an attachment direction in which the cartridge is attached to the attachment portion, in which the developing device includes:

a developer bearing member configured to bear the developer in order to develop the electrostatic latent image formed on the image bearing member;

a developing container having: a first chamber in which the developer bearing member is disposed and the developer is supplied to the developer bearing member; a second chamber divided by a partition wall separately from the first chamber, the second chamber allowing the developer to circulate between the first chamber and the second chamber; and an accommodating chamber having an opening portion, the accommodating chamber accommodating an initial developer;

a first conveyance screw disposed in the first chamber, the first conveyance screw being configured to convey the developer in a first direction;

a second conveyance screw disposed in the second chamber, the second conveyance screw being configured to convey the developer in a second direction opposite to the first direction; and a sealing sheet sealing the opening portion such that the initial developer is accommodated in the accommodating chamber, in which the cover includes a holding portion holding an end portion of the sealing sheet, in which, due to release of the seal of the opening portion with the sealing sheet, the initial developer accommodated in the accommodating chamber moves from the accommodating chamber to the second chamber through the opening portion, and in which the seal of the opening portion with the sealing sheet is released due to movement of the casing with respect to the cover and detachment of the cover from the casing, responsive to an operation of movement of the cartridge in the attachment direction, with the holding portion holding the end portion of the sealing sheet and the regulation portion regulating movement of the cover.

Further features of the present invention will become apparent from the following description of exemplary embodiments with reference to the attached drawings.

DESCRIPTION OF THE EMBODIMENTS

Exemplary embodiments of the present invention will be described in detail below with reference to the drawings. Note that the dimensions, material, and shape of each of the constituent components and the relative arrangement thereof in the following embodiments should be appropriately changed according to the configuration of an apparatus to which the present invention is applied or various types of conditions, and thus should not be construed to limit the scope of the present disclosure.

First Embodiment

[Image Forming Apparatus]

Figure 1:
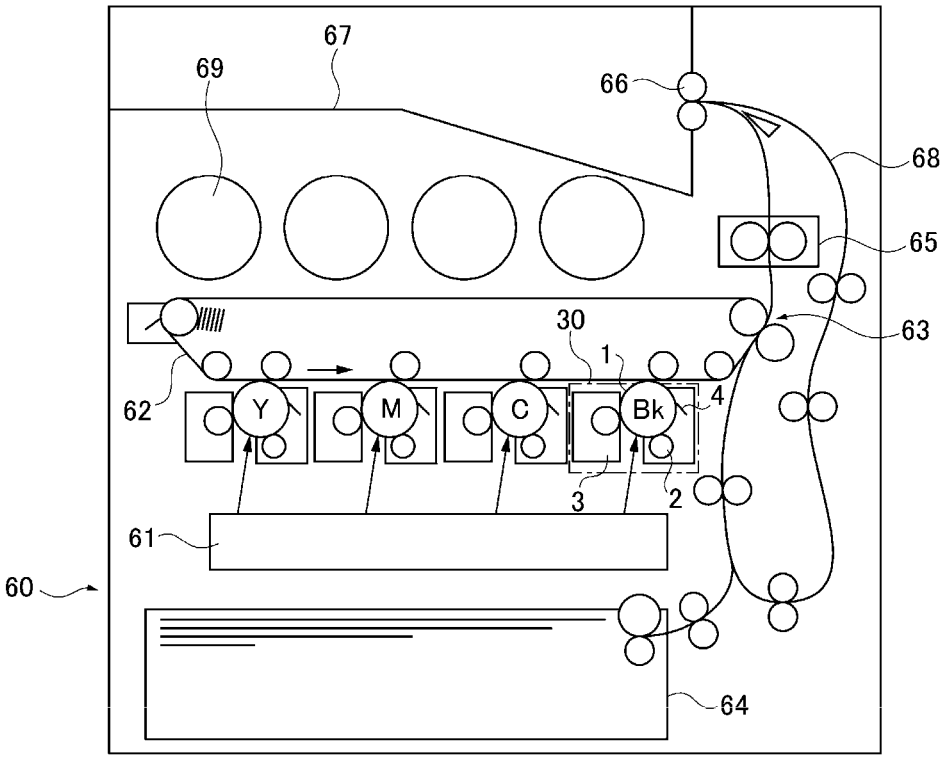
FIG. 1 is a sectional view of a schematic configuration of an image forming apparatus.

A schematic configuration of an image forming apparatus according to the present embodiment will be described with FIG. 1. FIG. 1 is a sectional view of the schematic configuration of the image forming apparatus. The image forming apparatus 60 is of a so-called tandem type and includes process cartridges 30 for the colors of yellow (Y), magenta (M), cyan (C), and black (Bk) arranged side by side in the rotation direction of an intermediate transfer belt 62 as an intermediate transfer member. The process cartridges 30 for the colors each form a toner image of the corresponding color as described below. Then, the toner images of the colors are primary-transferred to the intermediate transfer belt 62 in sequence, resulting in formation of a full-color toner image on the intermediate transfer belt 62. The full-color toner image on the intermediate transfer belt 62 is transferred, at a secondary transfer portion 63, to a recording material (a sheet material, such as a sheet of paper or an OHP sheet) conveyed from a cassette 64. Then, the full-color toner image transferred to the recording material is fixed to the recording material due to heating and pressing by a fixing device 65. The recording material having the toner image fixed thereto is discharged to a discharge tray 67 through a discharge portion 66. For duplex printing, the recording material is conveyed to the secondary transfer portion 63 again through a conveyance path 68 for duplex printing.

[Process Cartridge]

Figure 2:
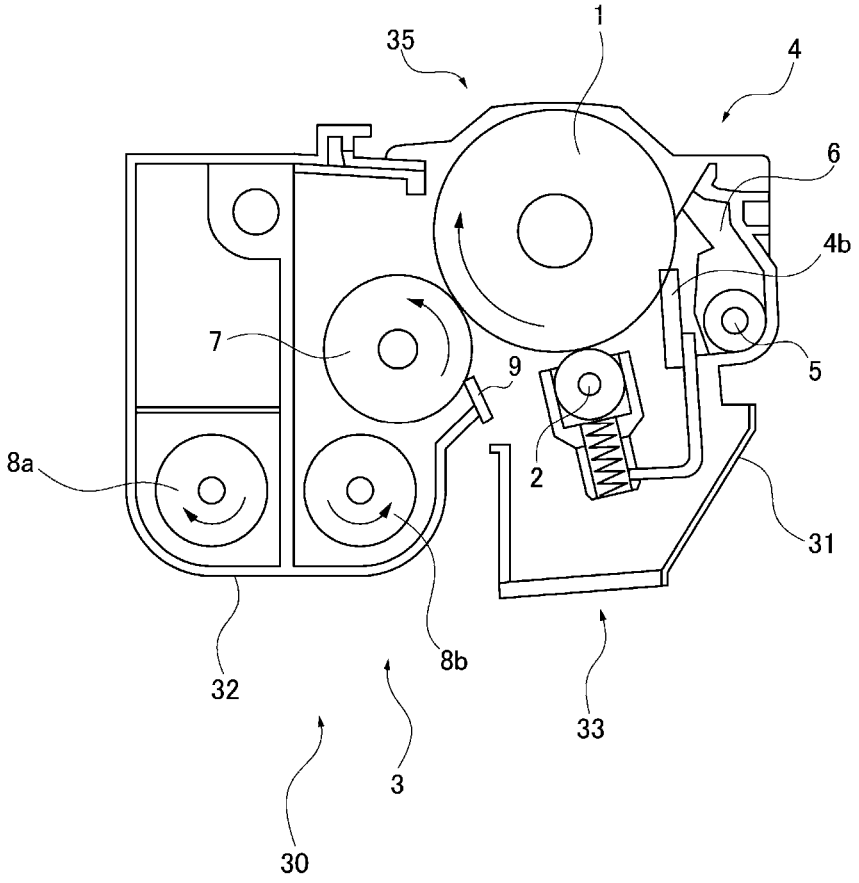
FIG. 2 is a sectional view of a schematic configuration of a process cartridge.

Next, a schematic configuration of such a process cartridge 30 as described above will be described with FIGS. 1 and 2. FIG. 2 is a sectional view of a schematic configuration of a process cartridge. Note that the process cartridges 30 for the colors are basically similar in configuration. Such a process cartridge 30 includes at least a photoconductive drum 1 as an image bearing member and a cartridge casing 31 holding the photoconductive drum 1, and is detachably attachable to the image forming apparatus 60. As described below, the process cartridge 30 enables detachably attachment of a protective cover 10 (refer to FIGS. 4A and 4B) that covers an exposure portion 35 from which part of the surface of the photoconductive drum 1 is exposed.

The process cartridge 30 according to the present embodiment includes, in addition to the photoconductive drum 1 as an image bearing member, a charging device 2, a cleaner device 4, and a developing device 3 that serve as a process portion that forms an image on the photoconductive drum 1. Such a process cartridge 30 is detachably attached, in the longitudinal direction of the photoconductive drum 1 (first direction), to the image forming apparatus 60.

The process cartridge 30 will be more specifically described. As illustrated in FIG. 2, the process cartridge 30 includes a photoconductor device 33 in combination with the developing device 3. The photoconductor device 33 includes the photoconductive drum 1 supported rotatably by the cartridge casing 31, the charging device (charging roller) 2 as a charging portion, and the cleaner device 4 as a cleaning portion. The developing device 3 includes conveyance screws 8*a* and 8*b* supported rotatably by a developing container 32, a regulation blade 9, and a developing sleeve 7. Note that such a developing device 3 will be described in detail below.

[Image Forming Process]

The image forming apparatus 60 having such process cartridges 30 attached thereto forms a toner image as follows. When a process cartridge 30 is attached to a predetermined attachment position in the image forming apparatus 60, as illustrated in FIG. 1, the photoconductive drum 1 exposed from the exposure portion 35 faces the intermediate transfer belt 62. In this state, the charging device 2 charges the surface of the photoconductive drum 1 driven in rotation to a predetermined potential. Then, the charged surface of the photoconductive drum 1 is irradiated with laser light from an exposer 61 according to image information regarding the corresponding color, so that an electrostatic latent image is formed. The electrostatic latent image on the photoconductive drum 1 is developed as a toner image with the corresponding color toner by the developing device 3.

The developing device 3 has a two-component developer containing magnetic carriers and nonmagnetic toner accommodated in the developing container 32. Due to stirring conveyance of the two-component developer by the conveyance screws 8*a* and 8*b*, the carriers and the toner are mutually charged. The developer containing the charged carriers and toner is bearing-conveyed by the developing sleeve 7 including a magnet portion 7*a* (refer to FIG. 3) inside, driven in rotation. The developer bearing-conveyed by the developing sleeve 7 is regulated to have a desired thickness by the regulation blade 9. Then, the regulated developer is conveyed to the region facing the photoconductive drum 1. Then, when a predetermined developing bias is applied between the developing sleeve 7 and the photoconductive drum 1, due to the toner, the electrostatic latent image on the photoconductive drum 1 is brought into a visible image.

Such image forming processes are performed parallel in the process cartridges 30 for the colors. Then, the visible toner images are transferred onto the intermediate transfer belt 62 in a sequentially superimposed manner such that the respective image tops thereof are identical, so that a full-color toner image is formed as described above. The toner left on the surface of the photoconductive drum 1 after transferring is wiped off by a cleaning blade 4*b* of the cleaner device 4. Then, the wiped-off toner is conveyed to a container for collecting toner, not illustrated, by a cleaner conveyance screw 5 provided in a cleaner collection space 6.

[Developing Device]

Figure 3:
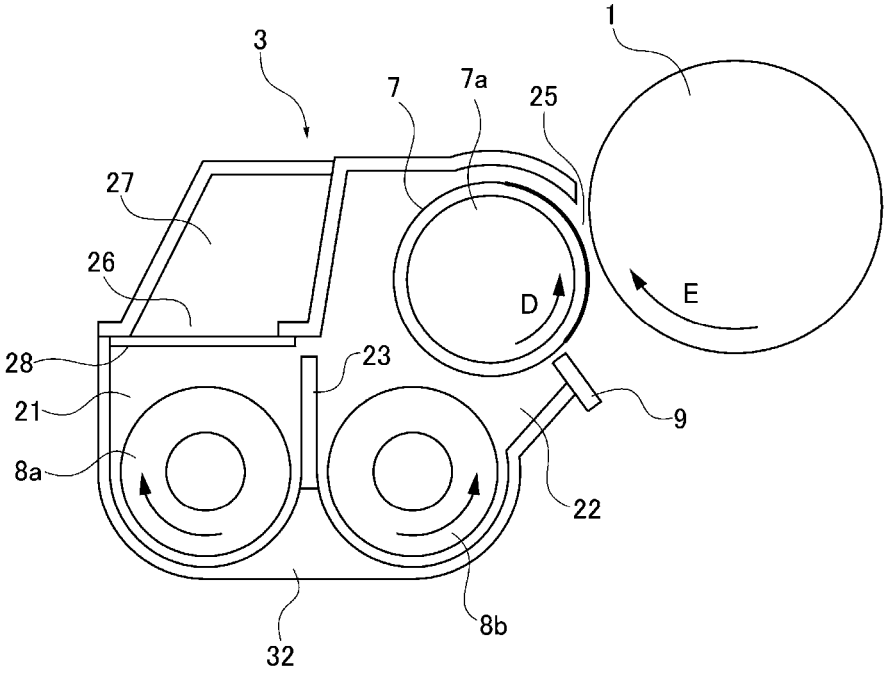
FIG. 3 is a sectional view of a schematic configuration of a developing device.

Next, a developing device 3 according to the present embodiment will be described with FIG. 3. FIG. 3 is a sectional view of a schematic configuration of the developing device. As described above, the developing device 3 according to the present embodiment has a two-component developer containing magnetic carriers and nonmagnetic toner accommodated in the developing container 32. The corresponding color toner is supplied from a toner cartridge 69 (refer to FIG. 1) set in the image forming apparatus 60 into the developing container 32 of the developing device 3 through a toner conveyance path not illustrated.

The developing device 3 includes the developing container 32 that stores a developer. The developing container 32 has, inside, a first conveyance chamber 21 and a second conveyance chamber 22 partitioned by a partition wall 23. The first conveyance chamber 21 and the second conveyance chamber 22 are in communication through both ends in the longitudinal direction. In the first conveyance chamber 21, a first conveyance screw 8*a* is supported rotatably as a first conveyance member. In the second conveyance chamber 22, a second conveyance screw 8*b* is supported rotatably as a second conveyance member. Then, when the two conveyance screws 8*a* and 8*b* are driven, the toner supplied in the developing container 32 circulates in the two conveyance chambers. Here, magnetic carriers are accommodated in advance in the developing container 32. The magnetic carriers and the toner are friction-charged by stirring during circulation in the first conveyance chamber 21 and then are conveyed to the second conveyance chamber 22.

The second conveyance screw 8*b* in the second conveyance chamber 22 is disposed opposite the developing sleeve 7 cylindrical in shape and conveys and supplies, to the developing sleeve 7, the toner adhering to the magnetic carriers due to friction-charging with the magnetic carriers. The developing sleeve 7 is supported rotatably, substantially parallel to the photoconductive drum 1, at a predetermined position in the developing container 32. The developing sleeve 7 is driven in rotation by a driving source not illustrated to bearing-convey the developer. The developing sleeve 7 has, inside, the magnet portion 7*a* of which the magnetic force causes the developing sleeve 7 to bear the developer. The developing sleeve 7 has the magnet portion 7*a* disposed in the rotational-axis direction of the developing sleeve 7 (longitudinal direction, namely, first direction). In order to produce a desired magnetic field, the magnet portion 7*a* is supported unrotatably such that a pattern of magnetic poles is fixed at a predetermined phase in the circumferential direction, and the developing sleeve 7 rotates around the magnet portion 7*a*.

Due to the magnetic force of the magnet portion 7*a*, the developing sleeve 7 as above bears, in a bristly form on its surface, the magnetic carriers having the toner adhering thereto due to friction-charging, supplied from the second conveyance screw 8*b*. Then, due to its rotation, the developing sleeve 7 conveys the toner and the carriers in the direction of arrow D of FIG. 3. Note that, in the present embodiment, the rotational direction of the developing sleeve 7 (direction of arrow D) is set as the forward direction with respect to the rotational direction of the photoconductive drum 1 (direction of arrow E), but may be set as the counter direction.

The developing container 32 has an opening 25 in the region facing the photoconductive drum 1. The opening 25 enables insertion of the developing sleeve 7. Then, the developing container 32 supports the developing sleeve 7 at the predetermined position described above such that part of the developing sleeve 7 is exposed from the opening 25. The developer of the toner and the carriers bearing-conveyed by the developing sleeve 7 as described above is regulated in thickness by the regulation blade 9 provided in proximity to the opening 25 and then is conveyed to a developing region in which the developing sleeve 7 and the photoconductive drum 1 face closely. In response to application of a developing bias between the developing sleeve 7 and the photoconductive drum 1, in the developing region, the electrostatic latent image formed on the photoconductive drum 1 is developed with the developer regulated in thickness as described above.

[Relationship Between Protective Cover and Process Cartridge]

Figure 4A:
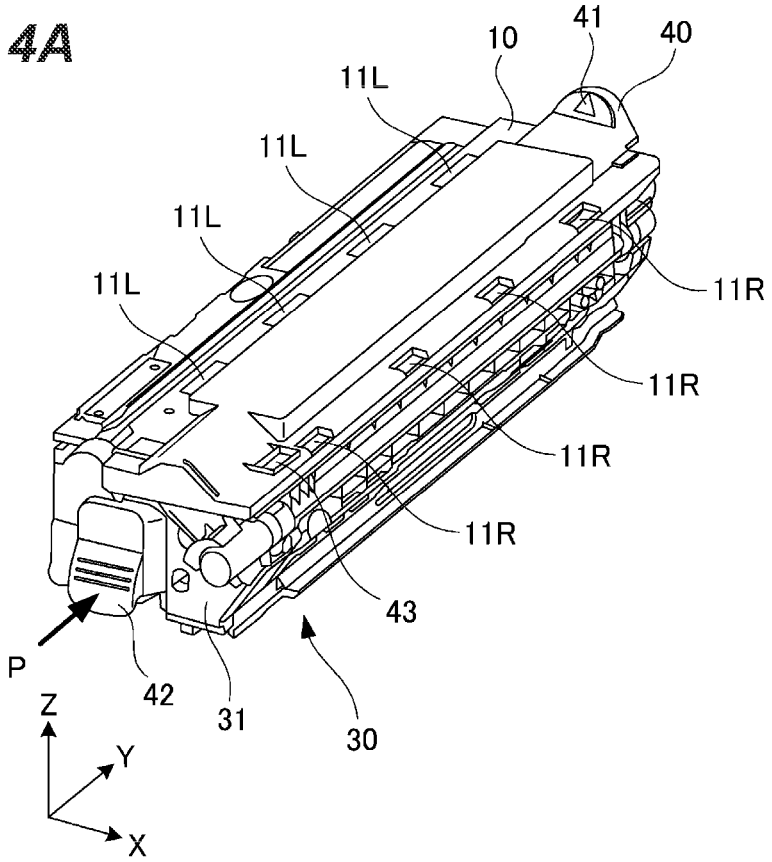
FIGS. 4A and 4B each illustrate a process cartridge having a protective cover attached thereto.
Figure 4B:
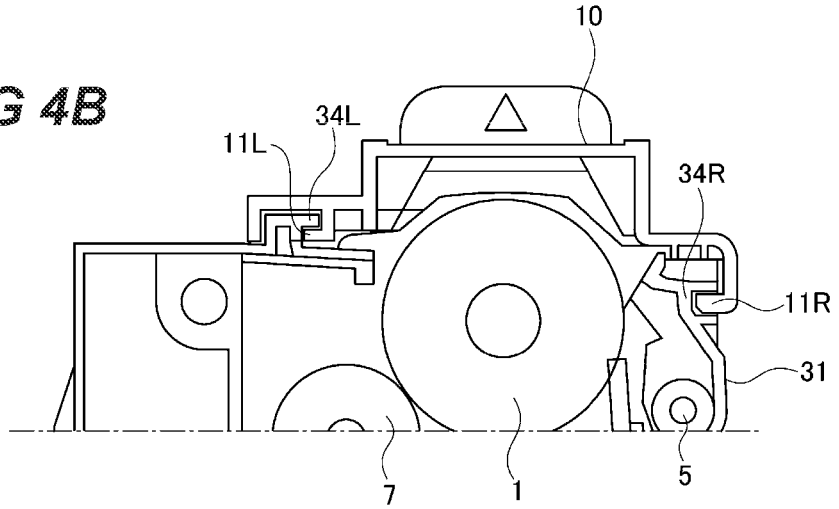

Next, the relationship between a protective cover 10 and a process cartridge 30 will be described with FIGS. 4A and 4B. FIG. 4A is a perspective view of a process cartridge having its protective cover attached thereto. FIG. 4B is a sectional view of the process cartridge having its protective cover attached thereto.

Note that, referring to FIG. 4A, the Y direction is the first direction and corresponds to the longitudinal direction of the photoconductive drum 1 (rotational-axis direction), namely, the rotational-axis direction of the developing sleeve 7. The Z direction is a second direction orthogonal to the first direction and corresponds to the up-down direction of the process cartridge 30 with respect to the image forming apparatus 60, namely, the up-down direction of the image forming apparatus 60 (vertical direction). The X direction is orthogonal to the first direction and the second direction and corresponds to the arrangement direction of four photoconductive drums, namely, the array direction of four process cartridges.

As described above, the process cartridge 30 has the cartridge casing 31 and the protective cover 10. The cartridge casing 31 holds the photoconductive drum 1 and has the exposure portion 35 from which part of the surface of the photoconductive drum 1 is exposed. The protective cover 10 is detachably attachable to the cartridge casing 31. The protective cover 10 having been attached to the cartridge casing 31 serves as a cover member that covers the exposure portion 35 (refer to FIG. 2) from which part of the surface of the photoconductive drum 1 in the cartridge casing 31 is exposed.

Along with an operation of insertion of the process cartridge 30 into the image forming apparatus 60 in the first direction, the cartridge casing 31 moves in the first direction relative to the protective cover 10 such that the exposure portion 35 is exposed. Thus, the protective cover 10 has a plurality of engagement projections 11R and a plurality of engagement projections 11L as an insertion guide portion that guides the cartridge casing 31 in the first direction along with an operation of insertion of the process cartridge 30. As illustrated in FIG. 4A, the plurality of engagement projections 11R and the plurality of engagement projections 11L are formed in the first direction across the photoconductive drum 1 in the X direction.

Meanwhile, as illustrated in FIG. 4B, the cartridge casing 31 has an engagement groove 34R that engages with the engagement projections 11R and an engagement groove 34L that engages with the engagement projections 11L, in the first direction. Then, due to the engagement between each engagement projection 11R and the engagement groove 34R and the engagement between each engagement projection 11L and the engagement groove 34L, the cartridge casing 31 is guided in the first direction with respect to the protective cover 10.

As illustrated in FIG. 4A, the protective cover 10 is provided with a locking portion 43 formed of a hook-shaped resin spring. With the protective cover 10 covering the exposure portion 35 of the cartridge casing 31 (attachment state), the locking portion 43 locks with part of the cartridge casing 31. In response to relative movement of the cartridge casing 31 in the first direction, the locking portion 43 is released from the locking with part of the cartridge casing 31. That is, as described below, a predetermined level of force or more on the locking portion 43 due to pushing of the process cartridge 30 in the insertion direction with the protective cover 10 disabled from moving deflects the resin spring of the locking portion 43, resulting in release of the hook from the locking.

[Attachment of Process Cartridge to Image Forming Apparatus]

Figure 5:
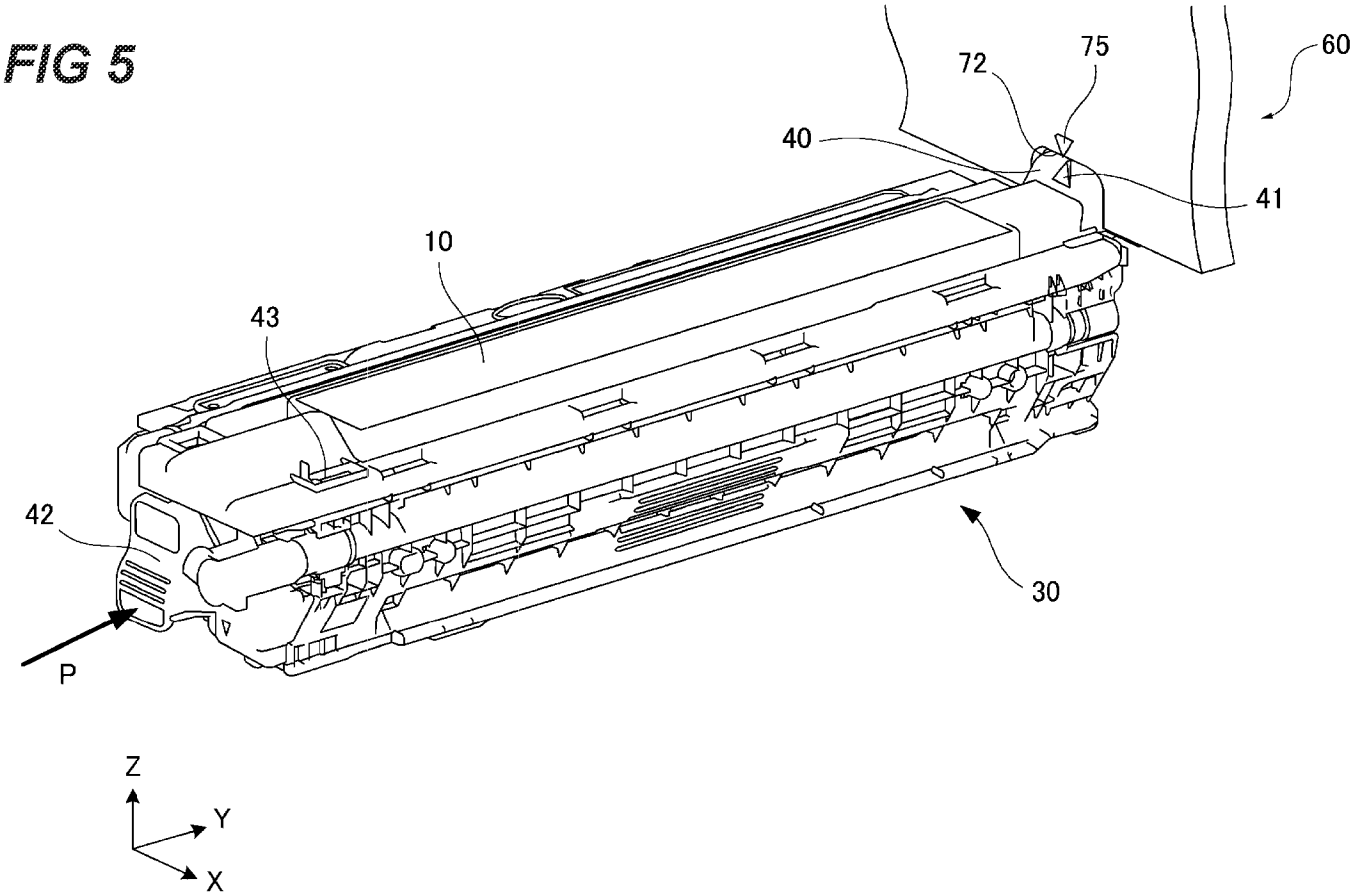
FIG. 5 is a perspective view of a process cartridge at the start of insertion to the image forming apparatus.
Figure 6:
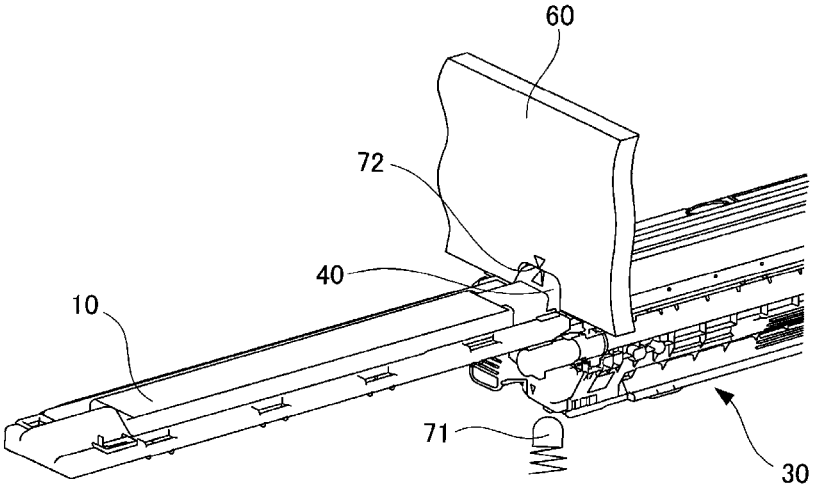
FIG. 6 is a perspective view of the process cartridge having reached an attachment position.

Next, the configuration and operation of attachment of a process cartridge 30 to the image forming apparatus 60 will be described with FIGS. 5 and 6. FIG. 5 is a perspective view of a process cartridge at the start of insertion to the image forming apparatus. FIG. 6 is a perspective view of the process cartridge having reached an attachment position inside the image forming apparatus.

As illustrated in FIG. 5, at the time of attachment of the process cartridge 30 to the image forming apparatus 60, an abutment portion (leading-end portion) 40 provided at the leading end of the protective cover 10 in the insertion direction (attachment direction, namely, first direction) fits with a regulation portion 72 provided at the image forming apparatus 60. Thus, the insertion position of the process cartridge 30 is determined to the image forming apparatus 60. At the time of insertion (attachment) of the process cartridge 30 in the first direction, the regulation portion 72 provided at the image forming apparatus 60 abuts on the abutment portion 40 as part of the protective cover 10, resulting in regulation of movement of the protective cover 10 in the first direction. Thus, along with an operation of insertion into the image forming apparatus 60 in the first direction, the process cartridge 30 (cartridge casing 31) moves in the first direction relative to the protective cover 10 such that the exposure portion 35 is exposed.

The abutment portion 40 of the protective cover 10 is provided with a mark 41, and the vicinity of the regulation portion 72 of the image forming apparatus 60 is provided with a mark 75. As illustrated in FIG. 5, at the time of insertion of the process cartridge 30 into the image forming apparatus 60, a user or service man enters the abutment portion 40 in the regulation portion 72 such that the mark 41 on the abutment portion 40 and the mark 75 on the image forming apparatus 60 are aligned. Then, with the alignment kept, pushing a grip 42 of the process cartridge 30 in the direction of arrow P (insertion direction) causes the abutment portion 40 to abut on the regulation portion 72. This results in positioning at the time of insertion of the process cartridge 30 into the image forming apparatus 60.

Then, due to further pushing the process cartridge 30 in the insertion direction, the process cartridge 30 starts to move relative to the protective cover 10 disabled from moving any more due to the abutment between the abutment portion 40 and the regulation portion 72. At this time, the locking portion 43 of the protective cover 10 is unlocked, so that the process cartridge 30 is inserted inside the image forming apparatus 60, leaving the protective cover 10 behind. In this case, because of the multiple engagement based on the engagement projections 11R and 11L of the protective cover 10 and the engagement grooves 34R and 34L of the cartridge casing 31, the protective cover 10 guides the process cartridge 30 in the Y-axis direction (insertion direction) while regulating the process cartridge 30 in the Z-axis direction (up-down direction) of FIG. 5.

As illustrated in FIG. 6, when the process cartridge 30 reaches the attachment position, an urging portion 71 provided in the image forming apparatus 60 gives the process cartridge 30 urging force. The urging portion 71 provided in the image forming apparatus 60 abuts on the process cartridge 30 immediately before the process cartridge 30 reaches the attachment position, to start upward urging to the process cartridge 30.

Because the urging force from the urging portion 71 acts as an insertion load against the force of insertion of the process cartridge 30 into the image forming apparatus 60 by the user, desirably, urging force is produced just short of the attachment position. Herein, the position at which the urging portion 71 produces urging force to the process cartridge 30 is a predetermined distance short of the attachment position. For example, the predetermined distance from the position at which the urging portion 71 starts to abut on the process cartridge 30 to the attachment position is 2 mm. In the present embodiment, because the variation in the position at which abutment starts between the process cartridge 30 and the urging portion 71 in the insertion direction is ±0.6 mm with respect to a predetermined position, a safety factor two times or more the variation is secured.

The process cartridge 30 having reached the attachment position as above is urged by the urging portion 71. Thus, the abutment portion 40 as the leading-end portion of the protective cover 10 is held by nipping between the process cartridge 30 and the image forming apparatus 60 (regulation portion 72).

Furthermore, the protective cover 10 is detached from the process cartridge 30 having reached the attachment position as above, so that the process cartridge 30 abuts on a positioning portion (not illustrated) of the image forming apparatus 60 due to urging by the urging portion 71. Then, the process cartridge 30 is positioned in the up-down direction (second direction) to the image forming apparatus 60, so that attachment of the process cartridge 30 to the image forming apparatus 60 is completed.

Here, the abutment portion (leading-end portion) 40 of the protective cover 10 before detachment from the process cartridge 30 is held, by nipping due to the urging force from the urging portion 71, between the process cartridge 30 and the image forming apparatus 60. In other words, with the process cartridge 30 attached, the urging portion 71 can give the process cartridge 30 urging force such that the leading-end portion of the protective cover 10 is nipped between the image forming apparatus 60 and the process cartridge 30. Thus, the protective cover 10 is held keeping its posture at the start of insertion of the process cartridge 30. Then, the user pulls out the held protective cover 10 in the direction opposite to the insertion direction, so that the protective cover 10 is detached from the process cartridge 30. Thus, as described above, the process cartridge 30 is positioned in the second direction to the image forming apparatus 60. In this case, because the protective cover 10 is nipped just due to the urging force from the urging portion 71, a grasp on any part of the protective cover 10 enables easy removal of the protective cover 10.

[Unused State (Initial State) of Process Cartridge]

Figure 7:
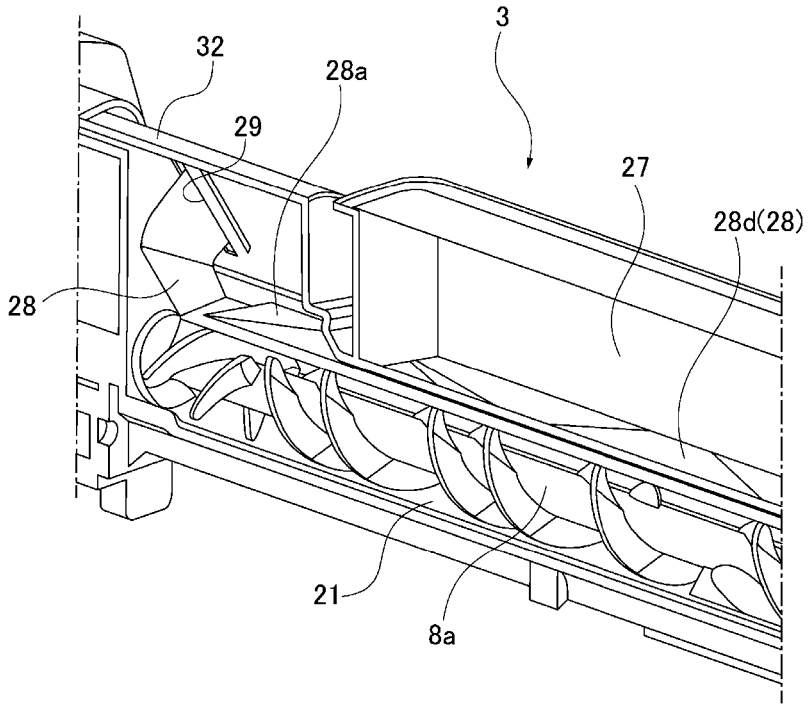
FIG. 7 is a sectional view of the configuration of a sealing sheet in the initial state of a process cartridge.
Figure 8:
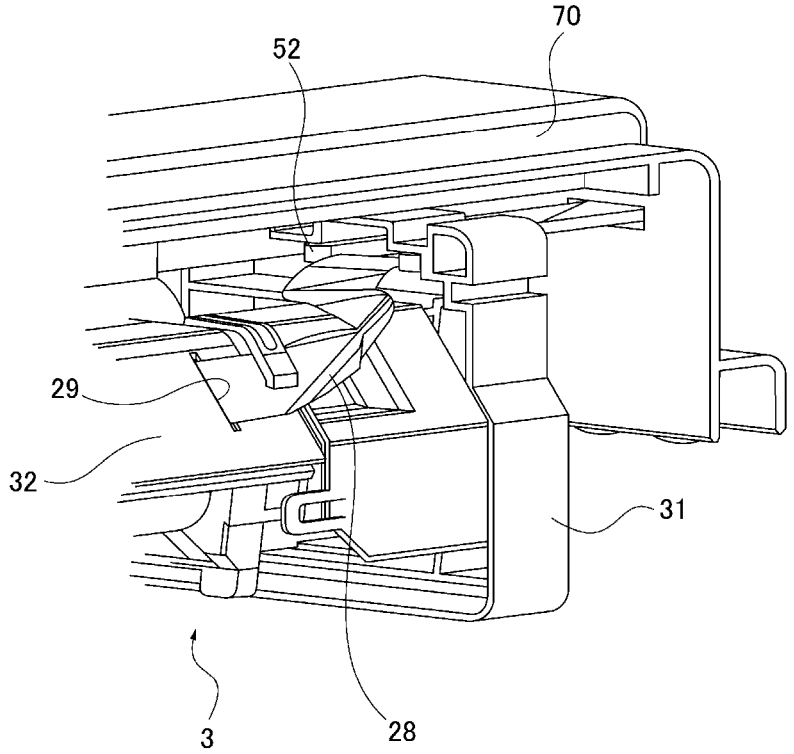
FIG. 8 is a perspective view of the configuration of the sealing sheet in the initial state of the process cartridge.
Figure 9:
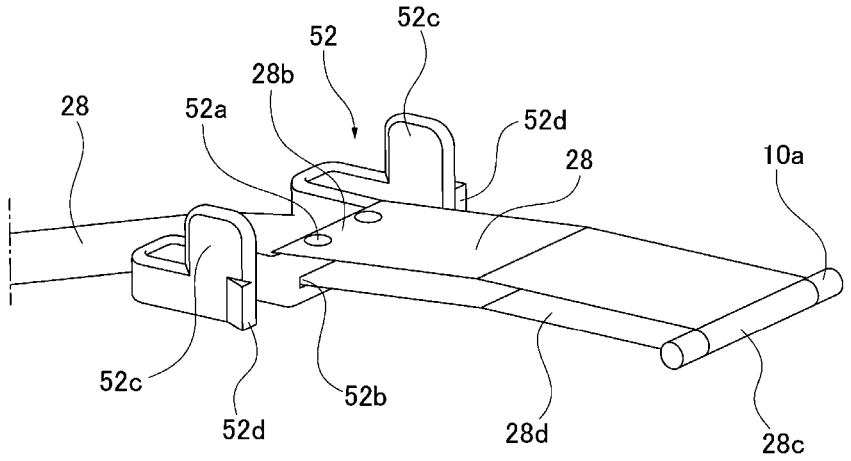
FIG. 9 is a perspective view of the configuration for pulling out the sealing sheet in the initial state of the process cartridge.
Figure 10:
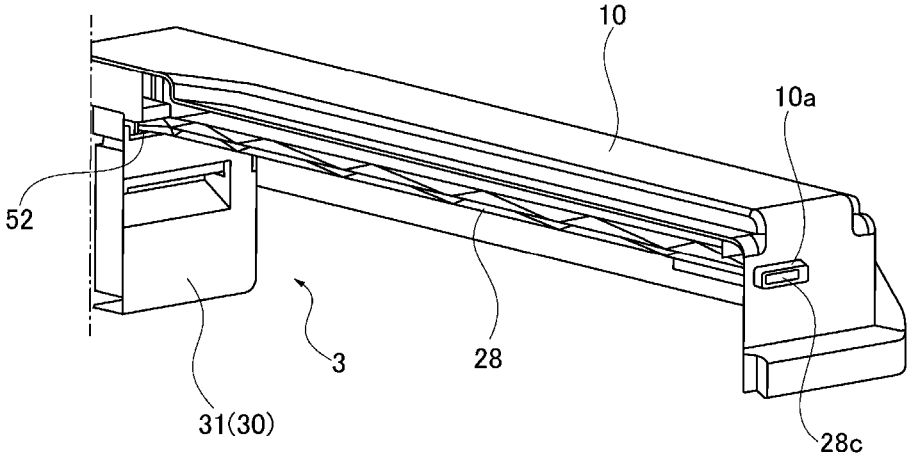
FIG. 10 is a perspective view of the configuration of the protective cover being removed from the process cartridge.
Figure 11C:
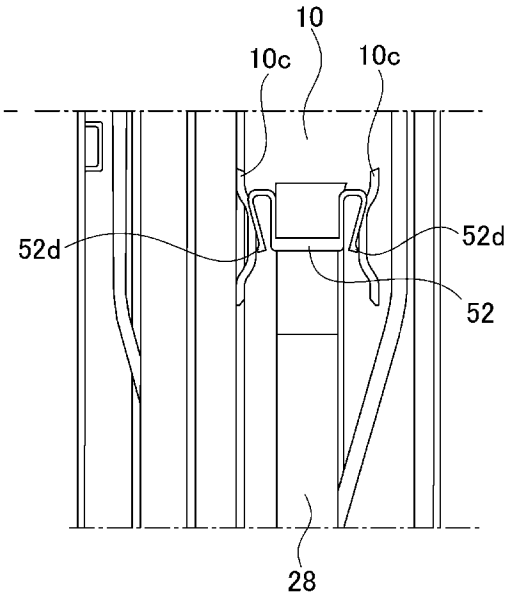
FIGS. 11A, 11B, and 11C illustrate an operation process of release of a fixing member with the protective cover being removed from the process cartridge.
Figure 11B:
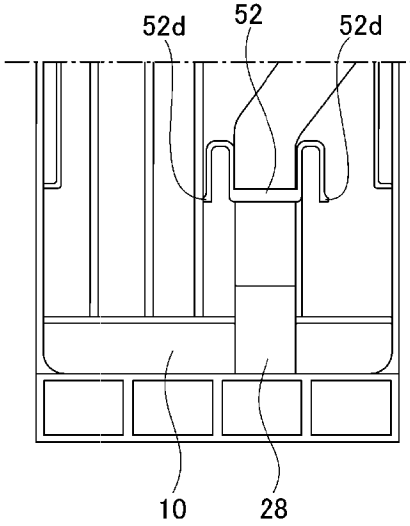
Figure 11A:
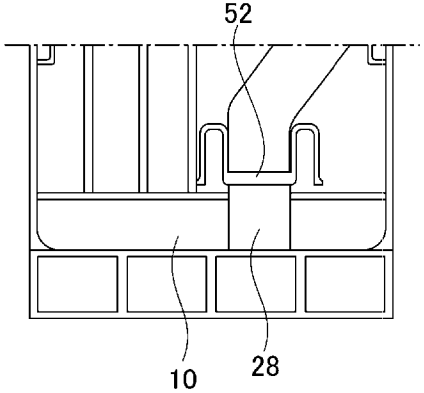
Figure 12A:
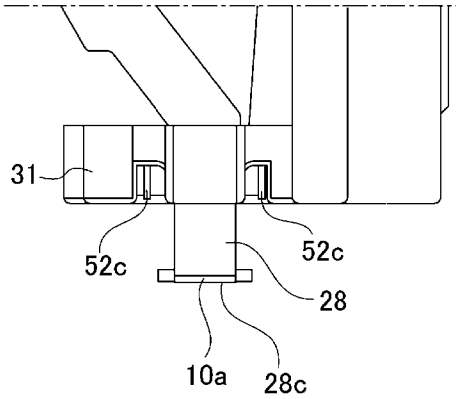
FIGS. 12A, 12B, and 12C illustrate an operation process of release of the fixing member with the protective cover being removed from the process cartridge.
Figure 12B:
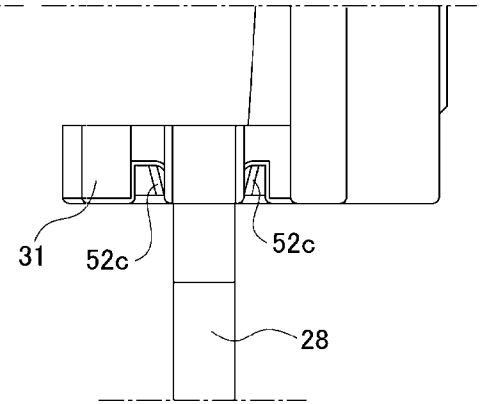
Figure 12C:
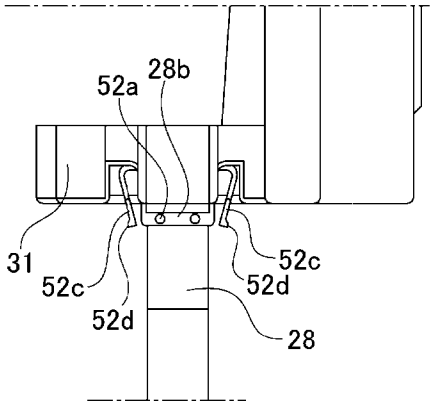

Next, the unused state (initial state) of a process cartridge 30 according to the present embodiment will be described with FIGS. 7 to 12C. FIG. 7 is a sectional view of the configuration of a sealing sheet in the initial state of a process cartridge. FIG. 8 is a perspective view of the configuration of the sealing sheet in the initial state of the process cartridge. FIG. 9 is a perspective view of the configuration for pulling out the sealing sheet in the initial state of the process cartridge. FIG. 10 is a perspective view of the configuration of the protective cover being removed from the process cartridge. FIGS. 11A, 11B, and 11C are bottom views of an operation process of release of a fixing member with the protective cover being removed from the process cartridge. FIGS. 12A, 12B, and 12C are top views of an operation process of release of the fixing member with the protective cover being removed from the process cartridge.

A process cartridge 30 before attachment to the image forming apparatus 60 has the protective cover 10 detachably attached to the cartridge casing 31 (refer to FIG. 4A). As described above, the protective cover 10 having been attached to the cartridge casing 31 serves as a cover member covering the exposure portion 35 (refer to FIGS. 2 and 4B) from which part of the surface of the photoconductive drum 1 in the cartridge casing 31 is exposed. Herein, the protective cover 10 also covers part of the developing device 3 integrally included in the process cartridge 30. Specifically, the protective cover 10 covers a fixing member 52 (refer to FIG. 8) mounted on the cartridge casing 31.

To be described below, in engagement with a folded-back portion 28*c* of a sealing sheet 28 folded back outside the developing device 3 integrally included in the process cartridge 30, the protective cover 10 is provided movably relative to the process cartridge 30.

Due to relative movement to the process cartridge 30 responsive to an operation of movement of the protective cover 10 in the axial direction of the photoconductive drum 1 with respect to the process cartridge 30, the protective cover 10 can be detached from the process cartridge 30. In addition, an operation of attachment of the process cartridge 30 to the image forming apparatus 60 enables detachment of the protective cover 10 from the process cartridge 30 due to relative movement to the process cartridge 30 because the protective cover 10 is regulated in movement due to abutment on the regulation portion 72 (refer to FIG. 6) of the image forming apparatus 60.

The developing device 3 integrally included in the process cartridge 30 includes the developing container 32 as described above (refer to FIG. 2). As illustrated in FIG. 3, the developing container 32 has, above the first conveyance chamber 21, an initial-developer accommodating chamber 27 that accommodates a developer to be supplied to the first conveyance chamber 21 through a communicating opening 26 for communication with the first conveyance chamber 21. The developing device 3 has an initial developer in advance accommodated at the time of shipping in the initial-developer accommodating chamber 27 above the first conveyance screw 8*a*.

As illustrated in FIG. 3, the communicating opening 26 for communication between the initial-developer accommodating chamber 27 and the first conveyance chamber 21 is sealed with the sealing sheet 28. The sealing sheet 28 is formed of a sheet member, such as a plastic film, and has a length two times or more the length in the longitudinal direction of the communicating opening 26. The sealing sheet 28 is welded by thermal welding at the outer circumferential portion of the communicating opening 26, sealing the communicating opening 26. Until first use, the seal of the communicating opening 26 with the sealing sheet 28 prevents the initial developer from deteriorating due to exposure to the outside air high in temperature and humidity and prevents the initial developer from scattering from any gap of the developing container 32, such as the opening 25.

Note that the example in which the sealing sheet 28 is welded at the outer circumferential portion of the communicating opening 26 has been given herein, but this is not limiting. For example, the sealing sheet 28 may adhere to, through adhesive, the outer circumferential portion of the communicating opening 26.

The sealing sheet 28 is folded back at one end in the longitudinal direction of the communicating opening 26 inside the developing container 32 and extends to the other end in the longitudinal direction. As illustrated in FIGS. 7 and 8, the sealing sheet 28 folded back inside the developing container 32 is discharged outward from the developing container 32 through a sheet discharge opening 29 provided at the developing container 32. At the sheet discharge opening 29, disposed is a sealing material (not illustrated) formed of an elastic member, such as a urethane material. The sealing material fills the gap between the sealing sheet 28 having passed through the sheet discharge opening 29 and the developing container 32, pinching the sealing sheet 28. The sealing material scrapes off the toner adhering to the sealing sheet 28 inside the developing container 32 and inhibits the toner inside the developing container 32 from scattering outward from the developing container 32 through the sheet discharge opening 29.

As illustrated in FIGS. 8 and 9, the fixing member 52 is mounted on the cartridge casing 31. The fixing member 52 has a hole portion 52*b* through which the folded-back sealing sheet 28 passes outward from the cartridge casing 31. The sealing sheet 28 having passed through the hole portion 52*b* is folded back outside the cartridge casing 31. The fixing member 52 has a fixing portion 52*a* that fixes an end portion 28*b* of the folded-back sealing sheet 28.

Note that the fixing member 52 has the hole portion 52*b* herein, but this is not limiting. For example, the cartridge casing 31 may be provided with a hole portion through which the folded-back sealing sheet 28 passes outward from the cartridge casing 31. Alternatively, the fixing member 52 and the cartridge casing 31 may form a hole portion through which the folded-back sealing sheet 28 passes outward from the cartridge casing 31. However, from the viewpoint of holding of the sealing sheet 28 pulled off from the outer circumferential portion of the communicating opening 26 by the fixing member 52 and detachment of the sealing sheet 28 together with the fixing member 52 from the cartridge casing 31, favorably, the fixing member 52 has the hole portion 52*b*.

The sealing sheet 28 discharged outside the developing container 32 through the sheet discharge opening 29 is turned upside down and then passes outward from the cartridge casing 31 through the hole portion 52*b* of the fixing member 52 mounted on the cartridge casing 31. That is, after turned upside down, the sealing sheet 28 passes outward from the process cartridge 30 through the hole portion 52*b* of the fixing member 52. The sealing sheet 28 having passed through the hole portion 52*b* is folded back outside the cartridge casing 31, and the end portion 28*b* of the folded-back sealing sheet 28 is fixed to the fixing portion 52*a*.

Herein, a shaft (not illustrated) provided at the fixing portion 52*a* of the fixing member 52 is inserted through a hole (not illustrated) provided at the end portion 28*b* of the sealing sheet 28, and the leading end of the shaft is fixed by thermal caulking. However, the method of fixing the end portion 28*b* of the sealing sheet 28 to the fixing portion 52*a* of the fixing member 52 is not limited to this. For example, the method may be adhesion with a two-sided adhesive tape.

In engagement with the folded-back portion 28*c* of the sealing sheet 28 folded back outside the cartridge casing 31, the protective cover 10 is provided movably relative to the process cartridge 30.

The folded-back portion 28*c* of the sealing sheet 28 folded back outside the cartridge casing 31 after passage through the hole portion 52*b* is movable in engagement with an engagement portion 10*a* of the protective cover 10. Herein, the engagement portion 10*a* of the protective cover 10 serves as a rotating member rotatably provided in the protective cover 10. Thus, in response to relative movement of the protective cover 10 to the process cartridge 30, the sealing sheet 28 moves due to rotation of the engagement portion 10*a*, so that a reduction can be made in load, leading to an improvement in operability. Note that the engagement portion 10*a* of the protective cover 10 is not limited to this in configuration. For example, the engagement portion 10*a* may have a contact face that is arc-shaped in the movement direction of the sealing sheet 28, between the engagement portion 10*a* and the folded-back portion 28*c* of the sealing sheet 28. Even in this case, in response to relative movement of the protective cover 10 to the process cartridge 30, the sealing sheet 28 moves along the shape of the contact face of the engagement portion 10*a*, so that a reduction can be made in load, leading to an improvement in operability.

The sealing sheet 28 having passed through the hole portion 52*b* is folded back outside the cartridge casing 31 such that a contact face 28*d* (refer to FIGS. 7 and 9) with the developer accommodated in the initial-developer accommodating chamber 27 is provided as the inner face.

The fixing member 52 has a snap-fit 52*d* as a locking portion that locks with the cartridge casing 31 and is fixed to the cartridge casing 31 by retaining due to the snap-fit 52*d*. That is, the fixing member 52 is mounted removably on the cartridge casing 31. The fixing member 52 has a tab portion 52*c* for releasing the locking of the snap-fit 52*d* with the cartridge casing 31. The tab portion 52*c* is provided to engage with a release rib 10*c* as a release portion provided at the protective cover 10 that moves relative to the process cartridge 30. Due to engagement with the release rib 10*c* of the protective cover 10, the snap-fit 52*d* deforms elastically in the direction of release of the locking, so that the fixing member 52 can be removed from the cartridge casing 31.

The protective cover 10 covers the fixing member 52 that is part of the developing device 3, and its length is longer than the length from one end to the other end in the longitudinal direction of the communicating opening 26. The length of the protective cover 10 is not more than half the entire length of the sealing sheet 28. Thus, an end portion 28*a* (refer to FIG. 7) of the sealing sheet 28 pulled off from the outer circumferential portion of the communicating opening 26 does not pass through the hole portion 52*b* of the fixing member 52, so that both end portions of the sealing sheet 28 are held by the fixing member 52.

As illustrated in FIG. 10, on one side in the longitudinal direction, the protective cover 10 has the engagement portion 10*a* engaging with the folded-back portion 28*c* of the sealing sheet 28 folded back outside the cartridge casing 31. As illustrated in FIG. 11C, on the other side in the longitudinal direction, the protective cover 10 has the release rib 10*c* as a release portion that releases the locking of the snap-fit 52*d* of the fixing member 52. The release rib 10*c* also functions as a holding portion that holds the fixing member 52 having the snap-fit 52*d* released from the locking. That is, the protective cover 10 has a holding portion (release rib 10*c*) that holds the fixing member 52 having the snap-fit 52*d* released from the locking. The function of the release rib 10*c* as a holding portion is not limited to this. For example, the release rib 10*c* of the protective cover 10 and the tab portion 52*c* of the fixing member 52 may function as a holding portion for retaining in the Z direction of FIG. 4A like the engagement projections 11R and 11L of the protective cover 10 and the engagement grooves 34R and 34L of the cartridge casing 31 illustrated in FIG. 4B. Alternatively, instead of the release rib 10*c* functioning as a holding portion, a holding portion may be provided separately from a release rib.

Due to relative movement of the protective cover 10 to the cartridge casing 31, the sealing sheet 28 is pulled off from the outer circumferential portion of the communicating opening 26. Due to further relative movement of the protective cover 10 to the cartridge casing 31 after pulling off, the release rib 10*c* releases the locking of the snap-fit 52*d* and then holds the fixing member 52 having been released from the locking, followed by detachment from the cartridge casing 31.

[Removal of Sealing Sheet]

Next, the operation at the time of removal of a sealing sheet will be described with FIGS. 10 to 12C. As illustrated in FIGS. 11A and 11B, in response to relative movement of the protective cover 10 to the process cartridge 30, as illustrated in FIGS. 10 and 12A, the folded-back portion 28*c* of the sealing sheet 28 moves together with the protective cover 10. Thus, the sealing sheet 28 is pulled out from the process cartridge 30, followed by the start of opening of the communicating opening 26 with the sealing sheet 28 being pulled off from the outer circumferential portion of the communicating opening 26.

In this case, the sealing sheet 28 is folded back from one side to the other side in the longitudinal direction inside the process cartridge and is further folded back from the other side to the one side in the longitudinal direction outside the process cartridge. Then, the folded-back portion 28*c* of the sealing sheet 28 outside the process cartridge is movable in engagement with the engagement portion 10*a* of the protective cover 10. Therefore, the folded-back portion 28*c* of the sealing sheet 28 moves, in the direction away from the process cartridge 30, together with the protective cover 10 that moves relative to the process cartridge 30. Thus, the sealing sheet 28 inside the process cartridge 30 moves by a length two times the distance of relative movement of the protective cover 10 and then is pulled out from the process cartridge. Thus, the length of the sealing sheet 28 for opening the communicating opening 26 is identical to the distance of the protective cover 10 required for relative movement. Thus, a reduction can be made in the work distance of pulling out the sealing sheet 28 at the time of opening of the accommodating chamber 27, leading to an improvement in operability.

In response to completion of opening of the accommodating chamber 27 (communicating opening 26) with the sealing sheet 28 pulled out, as illustrated in FIGS. 11C and 12B, the release rib 10*c* provided at the protective cover 10 comes in contact with the tab portion 52*c* of the fixing member 52. Thus, the snap-fit 52*d* deforms elastically, leading to release of the locking of the snap-fit 52*d* with the cartridge casing 31. Then, the fixing member 52 having been released from the locking is held, due to the restoring force of the snap-fit 52*d* having deformed elastically, at the release rib 10*c* (holding portion) of the protective cover 10. Thus, the sealing sheet 28 and the fixing member 52 after the completion of opening of the accommodating chamber 27 move together with the protective cover 10 in the direction of detachment from the process cartridge 30, resulting in removal from the process cartridge 30.

In the initial state of the developing device 3, the sealing sheet 28 is folded back outside the cartridge casing 31 such that the contact face 28*d* with the developer accommodated in the initial-developer accommodating chamber 27 is provided as the inner face. Thus, the contact face 28*d* of the sealing sheet 28 is provided as the inner face between the fixing member 52 and the protective cover 10 outside the process cartridge 30. Thus, the worker can pull out the sealing sheet 28 with a short work distance. In addition, because the face having toner adhering thereto is folded inward, the worker can be inhibited from being stained with the toner.

As described above, according to the present embodiment, due to relative movement of the protective cover 10 to the process cartridge 30, the sealing sheet 28 is pulled out. Thus, the sealing sheet is inhibited from being accidentally left, so that an improvement can be made in operability.

[Other Embodiments]

In the embodiment described above, for use, provided are four process cartridges detachably attachable to the image forming apparatus. However, the number of process cartridges for use is not limited to four and thus may be appropriately set as necessary.

In the embodiment described above, as a process cartridge detachably attachable to the image forming apparatus, exemplified has been a process cartridge including, integrally, a photoconductive drum, and a charging portion, a developing portion, and a cleaning portion that serve as a process portion that acts on the photoconductive drum. However, this is not limiting. Thus, provided may be a process cartridge including, integrally, a photoconductive drum and any one of a charging portion, a developing portion, and a cleaning portion. A developing device (developing portion) may be provided separately from a process cartridge and may be detachably attachable to the image forming apparatus.

In the embodiment described above, the image forming apparatus as a printer has been exemplified, but the present invention is not limited to this. For example, provided may be an image forming apparatus such as a copying machine or a facsimile device, or an image forming apparatus such as a multi-function peripheral having such functions in combination. Exemplified has been the image forming apparatus that includes the intermediate transfer member, transfers the respective toner images of the colors to the intermediate transfer member in a sequentially superimposed manner, and transfers the toner images borne on the intermediate transfer member, collectively, to a recording material. However, this is not limiting. For example, provided may be an image forming apparatus that includes a recording-material bearing member and transfers the respective toner images of colors to a recording material borne on the recording-material bearing member in a sequentially superimposed manner. Application of the present invention to such image forming apparatuses or developing devices for use in such image forming apparatuses enable acquisition of similar effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-095938, filed Jun. 8, 2021, which is hereby incorporated by reference herein in its entirety.

What is claimed is:

1. An image forming apparatus comprising:

a cartridge including: an image bearing member; a developing device configured to develop, with a developer containing toner and carriers, an electrostatic latent image formed on the image bearing member; a casing supporting the image bearing member; and a cover detachably attached to the casing, the cover covering the image bearing member such that the image bearing member is kept unexposed;

an attachment portion to which the cartridge is attachable; and a regulation portion configured to regulate movement of the cover in contact with the cover in response to movement of the cartridge in an attachment direction in which the cartridge is attached to the attachment portion, wherein the developing device includes:

a developer bearing member configured to bear the developer in order to develop the electrostatic latent image formed on the image bearing member;

a developing container having: a first chamber in which the developer bearing member is disposed and the developer is supplied to the developer bearing member; a second chamber divided by a partition wall separately from the first chamber, the second chamber allowing the developer to circulate between the first chamber and the second chamber; and an accommodating chamber having an opening portion, the accommodating chamber accommodating an initial developer;

a first conveyance screw disposed in the first chamber, the first conveyance screw being configured to convey the developer in a first direction;

a second conveyance screw disposed in the second chamber, the second conveyance screw being configured to convey the developer in a second direction opposite to the first direction; and a sealing sheet sealing the opening portion such that the initial developer is accommodated in the accommodating chamber, wherein the cover includes a holding portion holding an end portion of the sealing sheet, wherein, due to release of the seal of the opening portion with the sealing sheet, the initial developer accommodated in the accommodating chamber moves from the accommodating chamber to the second chamber through the opening portion, and wherein the seal of the opening portion with the sealing sheet is released due to movement of the casing with respect to the cover and detachment of the cover from the casing, responsive to an operation of movement of the cartridge in the attachment direction, with the holding portion holding the end portion of the sealing sheet and the regulation portion regulating movement of the cover.

2. The image forming apparatus according to claim 1, wherein the developing container further has a discharge portion through which the sealing sheet is discharged outward from inside the developing container, and wherein, due to discharge of the sealing sheet outward from inside the developing container through the discharge portion, the seal of the opening portion with the sealing sheet is released.

3. The image forming apparatus according to claim 1, wherein the accommodating chamber is disposed above the second chamber in a vertical direction.

* * * * *